US007895715B2

(12) United States Patent
Leger

(10) Patent No.: US 7,895,715 B2
(45) Date of Patent: Mar. 1, 2011

(54) FLEECE-LAYING DEVICE

(75) Inventor: Joachim Leger, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 98 days.

(21) Appl. No.: 12/535,280

(22) Filed: Aug. 4, 2009

(65) Prior Publication Data

US 2010/0043179 A1 Feb. 25, 2010

(30) Foreign Application Priority Data

Aug. 21, 2008 (EP) ..... 08014853

(51) Int. Cl.
*D01G 25/00* (2006.01)

(52) U.S. Cl. ..... 19/296

(58) Field of Classification Search ..... 19/296
See application file for complete search history.

(56) References Cited

U.S. PATENT DOCUMENTS

| | | | | |
|---|---|---|---|---|
| 4,830,351 | A | 5/1989 | Stanislaw | |
| 4,984,772 | A * | 1/1991 | Freund | 270/30.01 |
| 5,590,442 | A * | 1/1997 | Hirschek et al. | 19/163 |
| RE35,982 | E * | 12/1998 | Freund | 191/63 |
| 6,550,107 | B1 * | 4/2003 | Jourde et al. | 19/163 |

FOREIGN PATENT DOCUMENTS

| | | |
|---|---|---|
| EP | 0522893 A2 | 5/1992 |
| EP | 0865521 | 9/1999 |
| EP | 1010786 A2 | 6/2000 |
| EP | 1010787 A2 | 6/2000 |
| EP | 1816243 A1 | 8/2007 |

* cited by examiner

*Primary Examiner* — Shaun R Hurley

(74) *Attorney, Agent, or Firm* — Jansson Shupe & Munger Ltd

(57) ABSTRACT

A fleece-laying device for laying a fleece from a card web having a laying carriage movable above and transversely to an output conveyor belt, an upper carriage also movable transversely to the output conveyor belt, and a first card web conveyor belt and a second card web conveyor belt for guiding the card web via the upper carriage and the laying carriage into a laying nip formed in the laying carriage. The fleece-laying device includes a card web guiding area between the upper carriage and the laying carriage with two sections of the first and second card web conveyor belts holding the card web between them and being guided over at least one support roll mounted in a support carriage which is also movable transversely to the output conveyor belt.

14 Claims, 3 Drawing Sheets

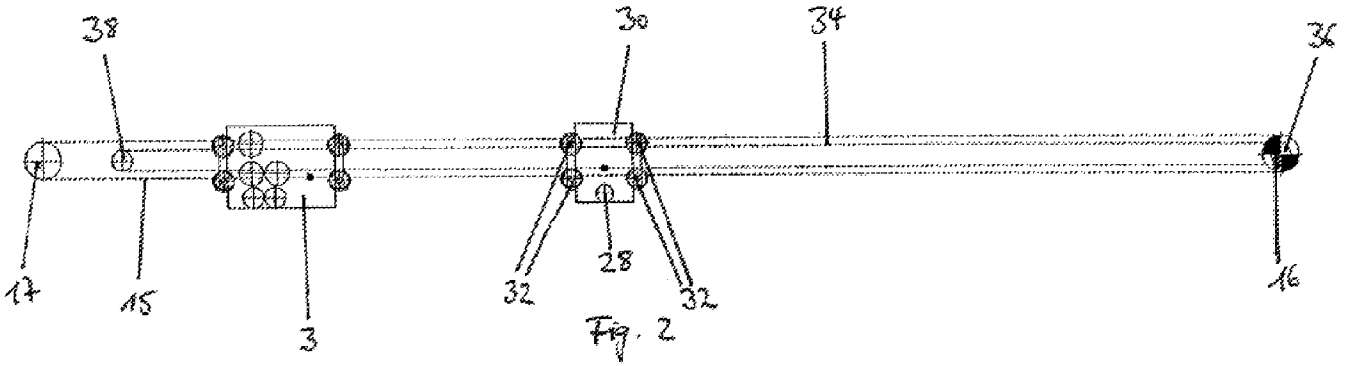
Fig. 2
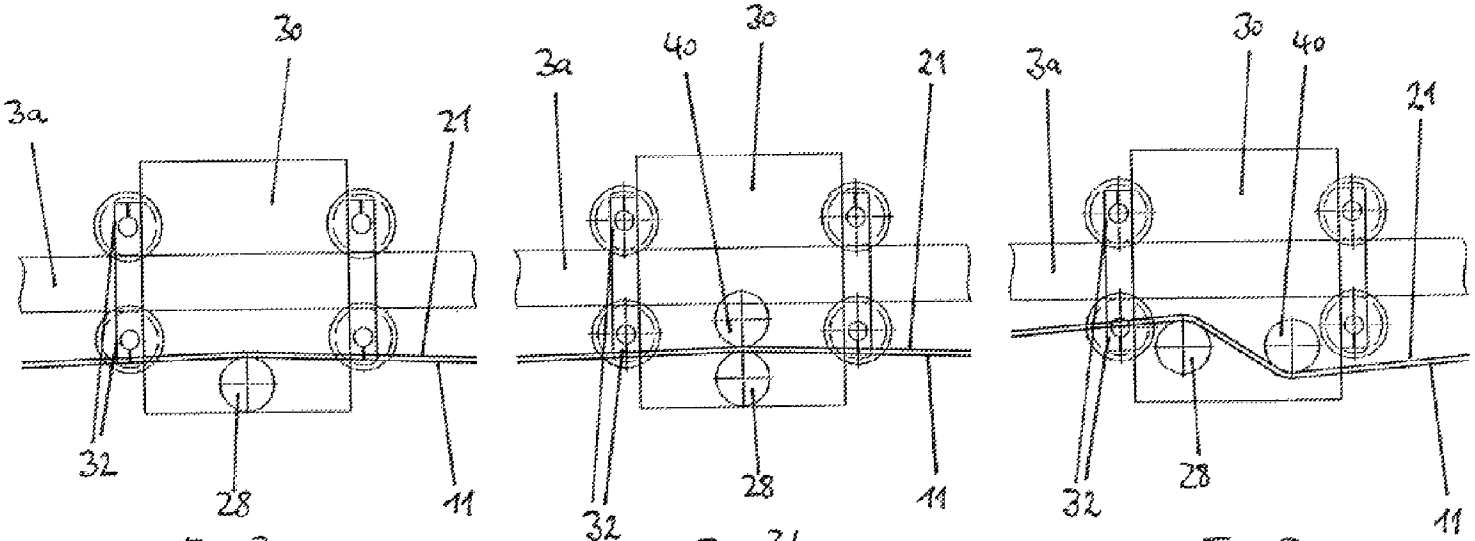
Fig. 3c
Fig. 3b
Fig. 3a

FLEECE-LAYING DEVICE

CROSS REFERENCE TO RELATED APPLICATION

This application claims priority based on European patent application 08 014 853.9, filed Aug. 21, 2008.

FIELD OF THE INVENTION

The present invention pertains to a fleece-laying device, especially a papermaker felt layer, in which a card web is laid on an output conveyor belt of considerable width to form a fleece.

BACKGROUND

These types of fleece layers have been known for a long time and are usually designed as in-phase layers, in which an upper carriage and a laying carriage each move back and forth in the same rhythm and in the same direction. Two card web conveyor belts are used to transport the card web to the laying nip in the laying carriage, wherein, in an area between the upper carriage and the laying carriage, the card web is sandwiched between two sections of the two card web conveyor belts. This ensures that the card web is guided securely to the laying nip. So that the fleece laid on the output conveyor belt will not be subjected to eddying (i.e. displacements, irregularities, etc.) caused by air eddies, the lower sections of the card web conveyor belts serve simultaneously as cover belts, which cover the laid fleece. Examples of fleece-laying machines are known from U.S. Pat. No. 4,830,351 and EP 0 522 893 A. A specially designed embodiment of a fleece layer is known from EP 1 816 243 A1.

During the transport of the card web through the fleece layer, the high belt speeds cause problems with belt guidance in the area of the lower strands of the belts which function as cover belts. This is especially true in the case of very wide fleece layers such as papermaker felt layers. This lack of guidance has the undesirable side effect that, as a result of the upward and downward movement of the sections of the card web conveyor belts functioning as cover belts, the fleece which has already been laid on the output conveyor belt is subjected to considerable air turbulence and thus to eddying.

To avoid the oscillation of the lower sections of the card web conveyor belts, a support carriage is provided in EP 1 010 787 B1. This carriage is located on the side of the laying carriage facing away from the upper carriage, and it supports the lower strand of the card web conveyor belt traveling on this side. The support carriage can be moved at the speed of the upper carriage and is especially helpful when the laying carriage is close to the upper carriage, because then the distance bridged by the lower strand of the card web conveyor belt to be supported is especially long.

In a similar manner, it is known from EP 1 010 786 B1 that a support carriage for the lower strand of the other card web conveyor belt can be rigidly connected to the upper carriage. It is especially useful in situations in which the laying carriage and the upper carriage are a considerable distance away from each other.

It has been found, however, that, especially in cases where the web is laid over a very wide output belt, the oscillations of the cover belts still subject the card web to eddying, and thus the uniformity of the laid fleece still leaves something to be desired.

SUMMARY OF THE INVENTION

It is an object of the present invention to provide a fleece-laying device in which eddying in the card web is avoided with even greater efficiency and as a result an especially uniform laying of the fleece is guaranteed.

According to an aspect of the invention, the fleece-laying device for laying a fleece from a card web includes a laying carriage movable above and transversely to an output conveyor belt, an upper carriage movable transversely to the output conveyor belt, and a first card web conveyor belt and a second card web conveyor belt for guiding the card web via the upper carriage and the laying carriage into a laying nip formed in the laying carriage.

The fleece-laying device includes a card web guiding area between the upper carriage and the laying carriage. Two sections of the first and second card web conveyor belts hold the card web between them and are guided over at least one support roll mounted in a support carriage which is also movable transversely to the output conveyor belt.

It is thus essentially guaranteed that the eddying of the card web caused by belt oscillations in the sandwich area of the fleece layer is almost completely excluded. Such elimination of eddying of the card web allows production of an especially uniform laying of the fleece on the output conveyor belt.

The support carriage can move preferably in a direction parallel to the direction of movement of the upper carriage and the laying carriage. This ensures that the support carriage does not interfere with the movement of the upper carriage and the laying carriage. At the same time it is possible to keep the support carriage in the middle between the upper carriage and the laying carriage and uniformly divide the intermediate space between the upper carriage and the laying carriage (i.e., the space which must be bridged by the two card web conveyor belts).

In one preferred embodiment, the support carriage can travel on rollers, which roll along rails or tubes.

To keep the overall structural design of the fleece-laying machine as simple as possible, the drive of the support carriage is preferably coupled to the drive of the laying carriage or to that of the upper carriage.

For this purpose, a chain or a toothed belt is attached to the support carriage and guided over a drive gear connected to a motor and around a deflection pulley. The support carriage drive gear is driven by the same shaft as a drive gear of the laying or upper carriage, although the circumference is different from that of the drive shaft of the laying carriage.

The support carriage can, in an alternative embodiment, comprise its own independent drive to allow the support carriage to perform more complex sequences of movements. It is advantageous for the purpose of suppressing belt oscillations in both the upward and downward direction for the device to include several support rolls.

In another preferred embodiment. the two sections of the two card web conveyor belts located between the upper carriage and the laying carriage can be guided through a gap between two support rolls. As a result, the generation of belt oscillations is prevented in a simple, cost effective and space-saving manner.

In another preferred embodiment, the two sections of the two card web conveyor belts located between the upper carriage and the laying carriage have a height at the point where they exit the support rolls which differs from the height at which they enter the support rolls. In this case, it is preferable for the two support rolls to be arranged next to each other and a certain distance apart. It is also preferable that the two sections of the two card web conveyor belts located between the upper carriage and the laying carriage to extend through the intermediate space between the support rolls. In this way, through the generation of a slight tension in the section of the belts between the support rolls, it is possible to avoid the occurrence of belt oscillations.

The device is preferably designed as an in-phase fleece layer. In this case, the support carriage is preferably located between the upper carriage and the laying carriage and on the same level as these two carriages, which simplifies the overall kinematics of the fleece layer.

It can also be especially advantageous for the drive of the support carriage to be designed in such a way that the support carriage moves in synchrony and synchronously with the upper carriage and the laying carriage, and at a speed which is between that of the laying carriage and that of the upper carriage.

BRIEF DESCRIPTION OF THE DRAWINGS

The invention is explained in greater detail below with reference to the exemplary embodiments shown in the drawings:

FIG. 2 is a schematic diagram of an example of a drive design for the support carriage and the laying carriage applicable to the exemplary embodiment of FIG. 1;

FIGS. 3*a*-3*c* each show portions of the path of the card web conveyor belts through variously designed support carriages.

DETAILED DESCRIPTION OF THE INVENTION

Figure 1:
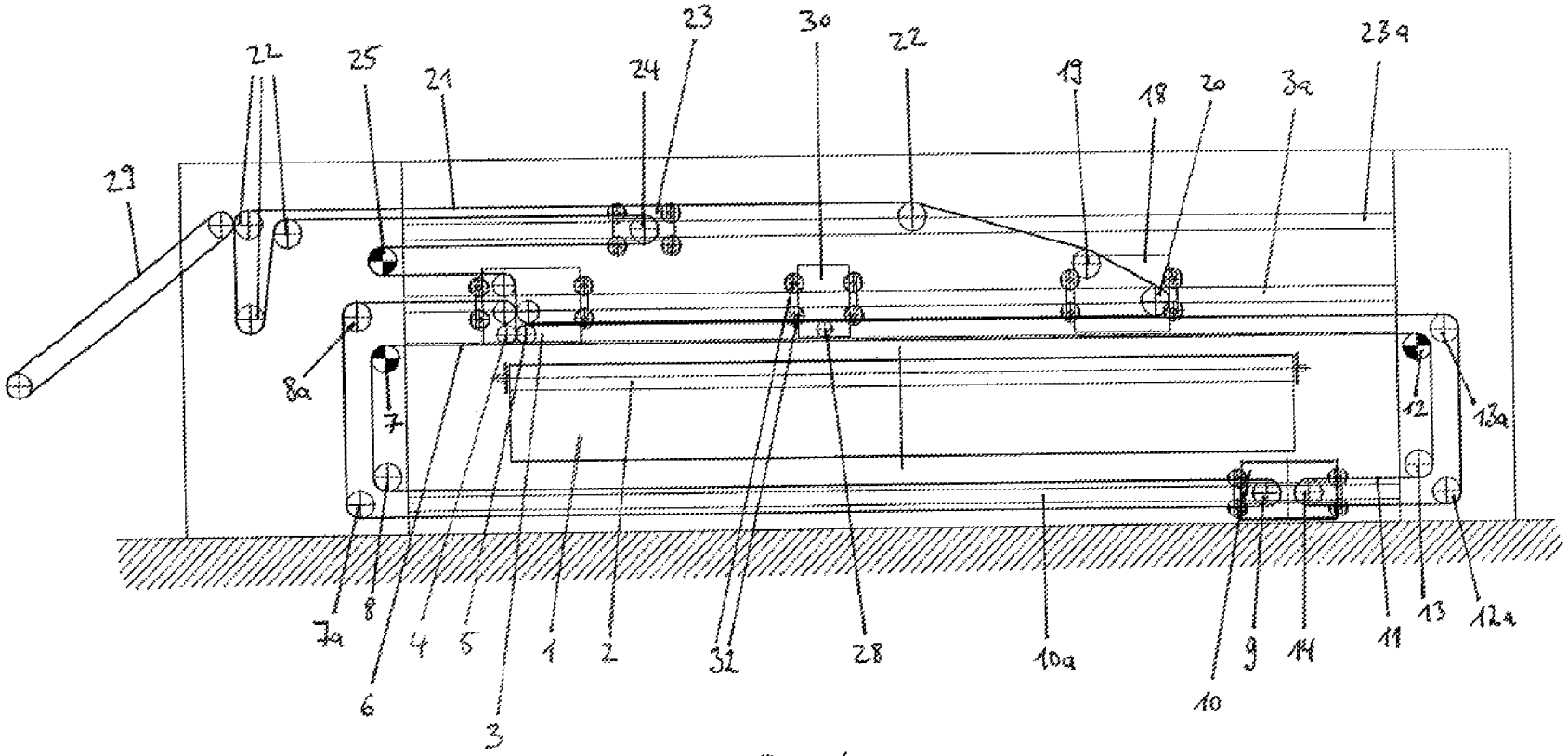
FIG. 1 is a schematic diagram of a first embodiment of the invention.

FIG. 1 is a schematic diagram of a first embodiment of the invention in a view looking at one end of the output conveyor belt. FIG. 1 illustrates an endless traveling output conveyor belt 1, which has the purpose of carrying away a laid fleece in a transport direction perpendicular to the plane of the drawing. An upper deflection roll 2 of the guide devices of the output conveyor belt is shown. Above the output conveyor belt 1, a laying carriage 3 can be moved back on forth on rails or tubes 3*a*. Two deflection rolls 4 and 5 are supported with freedom of rotation in laying carriage 3. The first deflection roll 4 is partially wrapped by a cover belt 6 comprising a lower strand, which passes just above output conveyor belt 1 to a driven deflection roll 7, then over another, stationary deflection roll 8, and finally to a deflection roll 9, which is rotatably supported in a first tension carriage 10. First tension carriage 10 is moveable underneath and transversely to output conveyor belt 1 on rails or tubes 10*a*. From deflection roll 9 supported in tension carriage 10, the previously mentioned cover belt 6 passes over two additional stationary deflection rolls 7*a* and 8*a* back to laying carriage 3. Driven deflection roll 7 is coupled to a motor (not shown) and has the purpose of driving cover belt 6 in different directions.

In a similar manner, the other deflection roll 5, which is rotatably supported in laying carriage 3, is partially wrapped by a card web conveyor belt 11, which is referred to below as the "second card web conveyor belt 11", and which is guided over driven deflection roll 12 and stationary deflection roll 13 to a second deflection roll 14. Deflection roll 14 is supported in first tension carriage 10 and is partially wrapped by card web conveyor belt 11. From there, card web conveyor belt 11 returns to laying carriage 3 by way of the additional stationary deflection rolls 12*a* and 13*a*. The second card web conveyor belt 11 comprises a lower strand, which passes just above output conveyor belt 1. The driven deflecting roll 12 is connected to a motor (not shown) and has the purpose of driving second card web conveyor belt 11 in different directions.

A chain or a toothed belt 15, which passes over a drive gear 16 connected to a motor (not shown) and around a deflection pulley 17, is attached to laying carriage 3 (see FIG. 2). By means of these drive devices, laying carriage 3 can be moved back and forth above output conveyor belt 1 transversely to its conveying direction.

An upper carriage 18, which is located essentially at the same height as laying carriage 3, is supported in the machine stand so that it can move on rails or tubes 3*a* transversely to the conveying direction of output conveyor belt 1. Rails or tubes 3*a* can be the same rails or tubes on which laying carriage 3 is also movably supported. Upper carriage 18 has an upper deflection roll 19 and a lower deflection roll 20, which are offset laterally from each other. Another card web conveyor belt 21, which is referred to below as the "first card web conveyor belt 21," passes over deflection rolls 19 and 20. First card web conveyor belt 21 passes downward at a slant through the area bounded by the two deflecting rolls 19 and 20 in upper carriage 18. Proceeding from the lower deflection roll 20 in upper carriage 18, first card web conveyor belt 21 passes parallel to the upper strand of second card web conveyor belt 11. After leaving laying carriage 3, first card web conveyor belt 21 is guided over a statically supported, motor-driven deflection roll 25, and from there it proceeds over a deflection roll 24, supported in a second tension carriage 23, so that it can then travel over several stationary deflection rolls 22 supported in the machine stand (referred to in the following as "stationary" rolls), before it arrives back at upper carriage 18. Upper carriage 18 and second tension carriage 23 are connected to each other by a chain or a toothed belt (not shown), which passes over a drive gear connected to a motor (not shown) and around a deflection pulley, which are supported in the machine stand (not shown). Tension carriage 23 is also supported so that it can move back and forth on rails or tubes 23*a*. As illustrated in FIG. 1, feed belt 29 passes upward at a slant and feeds the card web to be laid (not shown) to first card web conveyor belt 21.

In the area between lower deflection roll 20 of upper carriage 18 and second deflection pulley 5 of laying carriage 3, sections of first card web conveyor belt 21 and of second card web conveyor belt 11 are guided parallel to each other and close together. Such configuration the card web supplied by first card web conveyor belt 21 is sandwiched between first card web conveyor belt 21 and second card web conveyor belt 11 in the guiding area between upper carriage 18 and laying carriage 3. The card web is supported on second card web conveyor belt 11. Simultaneously, the lower strand of this second card web conveyor belt 11 also assumes the function of a cover belt for the laid fleece.

It can be seen from the drawing that, during operation, when laying carriage 3 executes back-and-forth movements across output conveyor belt 1, first tension carriage 10 executes the opposite movement, because the loop lengths of cover belt 6 and of second card web conveyor belt 11 are constant. Upper carriage 18 and its associated second tension carriage 23 also move in opposite directions during operation. Second tension carriage 23 is necessary to keep the loop length of first card web conveyor belt 21 constant.

The movements of laying carriage 3 and of upper carriage 18 are coordinated with each other in such a way that, if the card web is supplied via the feed belt 29 at uniform speed, the card web can be deposited onto output conveyor belt 1 without any stretching or compression within the fleece layer being described herein. Upper carriage 18 always moves in the same direction as laying carriage 3 but on average only half as fast. Account is also taken of the fact that laying carriage 3, in the area where it reverses its direction of travel, must be braked to a standstill and then accelerated again. The card web may be supplied at fluctuating speed, because, for example, a cyclically operating stretching mechanism may be installed upstream of feed belt 29 to generate an alternating thickness in the card web for the purpose of achieving a transverse profiling of the laid fleece. In such case, it is possible, with the help of independent controls of the movement of upper carriage 18 and of laying carriage 3, to provide a card web buffer function within the fleece layer.

At the point where they are deflected by deflection rolls 4 and 5 in laying carriage 3, card web conveyor belts 6 and 11 form a gap, which is referred to as the "laying nip" above. During the operation of the fleece layer, second card web conveyor belt 11 is driven in such a way that its upper strand travels at the same speed as the lower strand of first card web conveyor belt 21, because the two belts are supposed to keep the card web sandwiched between them as the web travels between upper carriage 18 and laying carriage 3.

According to this exemplary embodiment, a total of three belts are used in the fleece layer. The invention, however, can also be applied to any other type of fleece layer, including those with two belts, as long as two card web conveyor belts 11, 21 sandwich the card web in the area between upper carriage 18 and laying carriage 3 at least over a certain distance.

According to a preferred embodiment of the invention as illustrated in FIGS. 1 and 2, a support roll 28 is installed in the area between upper carriage 18 and laying carriage 3; this roll being designed as part of the support carriage 30. Support carriage 30 is supported so that it can travel on rollers 32 along rails or tubes 3*a*, which can be the same rails or tubes as those on which upper carriage 18 and laying carriage 3 are movably supported. Support carriage 30 also moves preferably synchronously with upper carriage 18 and laying carriage 3, but on average at a speed which is between that of upper carriage 18 and that of laying carriage 3. As a result, it is ensured that support roll 28 is always located about half-way between upper carriage 18 and laying carriage 3. To control the movement of support carriage 30, it can have its own independent drive, but it is advantageous for the drive of the support carriage to be connected to the drive of laying carriage 3 or to that of upper carriage 18.

A special form of the connection of the drive of support carriage 30 to the drive of laying carriage 3 is shown in FIG. 2. Here a chain or a toothed belt 34 is attached to support carriage 30. This chain or belt is guided over a drive gear 36 connected to a motor and around a deflection pulley 38. Drive gear 36 is preferably supported on the same shaft and driven by the same motor as those of drive gear 16 of laying carriage 3, but it has a much smaller circumference, so that the speed of support carriage 30, although proportional to the speed of laying carriage 3, is reduced to a corresponding extent.

It is also conceivable that the drive of support carriage 30 could be connected in a corresponding manner to the drive of upper carriage 18, wherein the circumference of drive gear 36 of support carriage 30 in this case would be larger than the circumference of the drive gear of upper carriage 18. Thus the speed of support carriage 30 would be proportional to the speed of upper carriage 18 but correspondingly greater.

Of course, a variety of alternative means for connecting the drive of support carriage 30 to that of upper carriage 18 or of laying carriage 3 could also be provided.

FIGS. 3*a*-3*c* show several variants of support carriage 30. In FIG. 3*a*, the sections of two card web conveyor belts 11, 21 between which the card web is sandwiched, rest only on support roll 28. The entry height of card web conveyor belts 11, 21 into support carriage 30 is the same as the exit height out of support carriage 30.

In FIG. 3*b*, card web conveyor belts 11, 21 are conducted through the nip between two support rolls 28, 40. In FIG. 3*c*, the entry height of card web conveyor belts 11, 21 into support carriage 30 is different from their exit height out of support carriage 30. Here, two support rolls 28, 40 are arranged next to each other in such a way that they form an intermediate space between them, through which two card web conveyor belts 11, 21 are guided. There are many other possible ways in which card web conveyor belts 11, 21 could be guided through support carriage 30.

Figure 4:
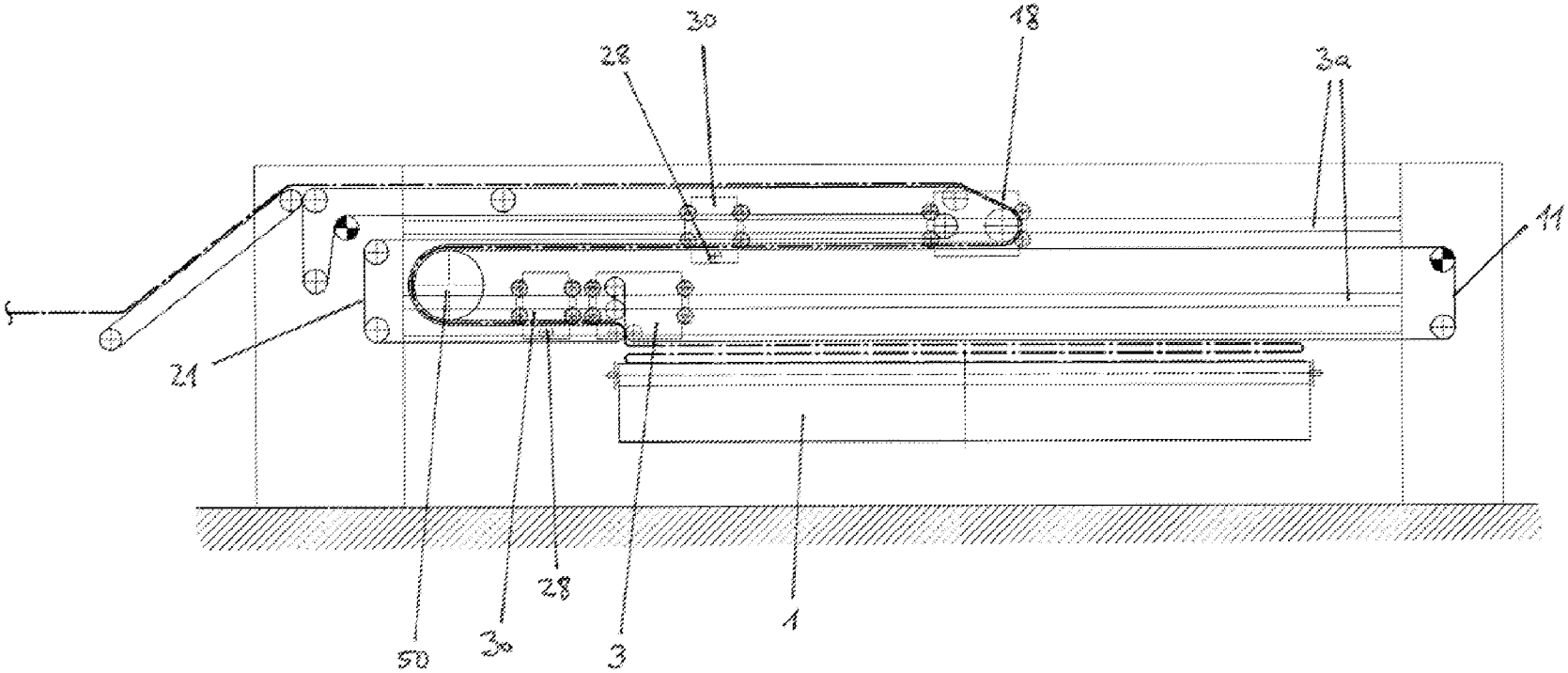
FIG. 4 is a schematic diagram of a second embodiment of the invention.

The invention is also applicable to opposing-phase fleece layers, in which upper carriage 18 and laying carriage 3 move in the same rhythm, but in opposite directions. An example of a fleece layer of this type is shown in FIG. 4. In this case, upper carriage 18 moves above laying carriage 3, and, in the guiding area between upper carriage 18 and laying carriage 3, the card web is deflected together with card web conveyor belts 11, 21 by 180°. In the example shown here, two card web conveyor belts 11, 21 are conducted together with the card web sandwiched between them over another stationary deflection roll 50. There are many other possible ways in which card web conveyor belts 11, 21 can be guided, as long as the card web is deflected by 180°.

In the case of an opposing-phase fleece layer, a support roll 28, preferably mounted in an appropriate support carriage 30, can be arranged both in the area between upper carriage 18 and deflection roll 50 and in the area between deflection roll 50 and laying carriage 3. Each support carriage 30 preferably travels along rails or tubes 3*a* on which upper carriage 18 and/or laying carriage 3 is also movably supported. The drives of two support carriages 30 are preferably connected to the drive of upper carriage 18 or to that of laying carriage 3 and can be moved synchronously with the carriage in question, wherein the speed of each support carriage 30 is preferably proportional to but slower than the speed of the associated carriage, i.e. upper carriage 18 or laying carriage 3.

While the invention has been described and illustrated in conjunction with specific preferred embodiments, it will be evident that many alternatives, modifications, variations and combinations will be apparent to those skilled in the art. Any such changes may be made without departing from the spirit and scope of the invention. The described and illustrated embodiments are to be considered in all respects only as illustrative and not restrictive. These and all similar modifications and changes are considered to be within the spirit and scope of the present invention.

What is claimed is:

1. A fleece-laying device for laying a fleece from a card web, the fleece-laying device comprising a laying carriage movable above and transversely to an output conveyor belt, an upper carriage also movable transversely to the output conveyor belt, and a first card web conveyor belt and a second card web conveyor belt for guiding the card web via the upper carriage and the laying carriage into a laying nip formed in the laying carriage, wherein, in a card web guiding area between the upper carriage and the laying carriage, two sections of the first and second card web conveyor belts hold the card web between them and are guided over at least one support roll mounted in a support carriage which is also movable transversely to the output conveyor belt.

2. The fleece-laying device of claim 1 wherein the support carriage is movable on rollers along rails or tubes.

3. The fleece-laying device of claim 1 wherein a drive of the support carriage is connected to a drive of the laying carriage or to a drive of the upper carriage.

4. The fleece-laying device of claim 3 wherein a chain or a toothed belt is attached to the support carriage, which chain or toothed belt passes over a drive gear of the support carriage connected to a motor and around a deflection pulley.

5. The fleece-laying device of claim 4 wherein the drive gear of the support carriage and a drive gear of the laying carriage are driven by a single shaft but comprise a different circumference.

6. The fleece-laying device of claim 4 wherein the drive gear of the support carriage and a drive gear of the upper carriage are driven by a single shaft but comprise a different circumference.

7. The fleece-laying device of claim 1 wherein the support carriage comprises an independent drive.

8. The fleece-laying device of claim 1 comprising at least two support rolls.

9. The fleece-laying device of claim 8 wherein the two sections of the first and second card web conveyor belts arranged between the upper carriage and the laying carriage are guided through a gap between two support rolls.

10. The fleece-laying device of claim 8 wherein the two sections of the first and second card web conveyor belts arranged between the upper carriage and the laying carriage have an exit height at a point where they leave the support rolls which differs from an entrance height into the support rolls.

11. The fleece-laying device of claim 9 wherein the two support rolls are arranged next to each other and a certain distance apart, and the two sections of the first and second card web conveyor belts arranged between the upper carriage and the laying carriage pass through an intermediate space between the support rolls.

12. The fleece-laying device of claim 1 wherein it is designed as an in-phase fleece layer where the upper carriage and the laying carriage at any time move in common directions.

13. The fleece-laying device of claim 12 wherein the support carriage is arranged between the upper carriage and the laying carriage and on a same level as the upper carriage and the laying carriage.

14. The fleece-laying device of claim 13 wherein a drive of the support carriage is designed in such a way that the support carriage moves in synchrony with the upper carriage and the laying carriage and at a speed which is between a speed of the laying carriage and a speed of the upper carriage.

* * * * *